US008942606B2

(12) United States Patent
Miyazaki

(10) Patent No.: US 8,942,606 B2
(45) Date of Patent: Jan. 27, 2015

(54) IMAGE FORMING APPARATUS USING A DEVELOPER IMAGE CARRIER MOVING IN A PREDETERMINED DIRECTION

(75) Inventor: Yoshitaka Miyazaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 104 days.

(21) Appl. No.: 13/431,962

(22) Filed: Mar. 27, 2012

(65) Prior Publication Data

US 2012/0251199 A1 Oct. 4, 2012

(30) Foreign Application Priority Data

Mar. 28, 2011 (JP) ..... 2011-069417

(51) Int. Cl.
*G03G 15/16* (2006.01)
*G03G 15/01* (2006.01)
*G03G 15/23* (2006.01)

(52) U.S. Cl.
CPC ..... *G03G 15/167* (2013.01); *G03G 15/0189* (2013.01); *G03G 15/235* (2013.01); *G03G 2215/0129* (2013.01)
USPC ..... 399/313; 399/66; 399/302

(58) Field of Classification Search
CPC . G03G 15/16; G03G 15/1605; G03G 15/161; G03G 2215/16; G03G 2215/1623; G03G 2215/1666
USPC ..... 399/313, 302, 303, 308, 66
See application file for complete search history.

(56) References Cited

U.S. PATENT DOCUMENTS

| | | | | |
|---|---|---|---|---|
| 8,548,365 | B2 * | 10/2013 | Tomura et al. | 399/302 |
| 2006/0104678 | A1 * | 5/2006 | Kuo et al. | 399/313 |
| 2009/0324306 | A1 * | 12/2009 | Echigo et al. | 399/314 |
| 2010/0135703 | A1 * | 6/2010 | Nakamura et al. | 399/313 |
| 2010/0239335 | A1 * | 9/2010 | Sawai | 399/319 |
| 2011/0318070 | A1 * | 12/2011 | Whitney et al. | 399/313 |

FOREIGN PATENT DOCUMENTS

| | | |
|---|---|---|
| JP | 10-055093 | 2/1998 |
| JP | 10-307446 | 11/1998 |
| JP | 2010-134141 A | 6/2010 |
| JP | 2010-217530 A | 9/2010 |

* cited by examiner

*Primary Examiner* — Sophia S Chen
(74) *Attorney, Agent, or Firm* — Rabin & Berdo, P.C.

(57) ABSTRACT

An image forming apparatus that transfers a developer image onto a sheet and forms the developer image on the sheet includes a developer image carrier, a first pressing member, a transfer member, a first voltage supply, and an adherence part. The developer image carrier holds the developer image and moves in a predetermined direction in which the sheet is being carried. The first pressing member presses against the developer image carrier from a side opposite to a side on which a developer image is held. The transfer member is arranged against the first pressing member through the developer image carrier, the first pressing member and the transfer member being responsive to a first voltage applied therebetween to transfer the developer image from the developer image carrier toward the transfer member. The adherence part adheres the sheet to the developer image carrier upstream the first pressing member in the predetermined direction.

19 Claims, 14 Drawing Sheets

FIG. 6A - PRIOR ART
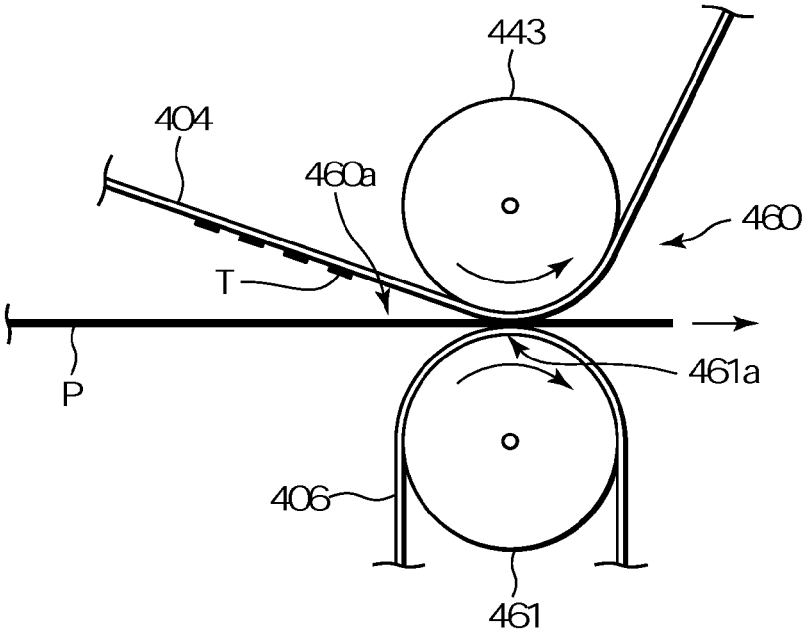
FIG. 6B
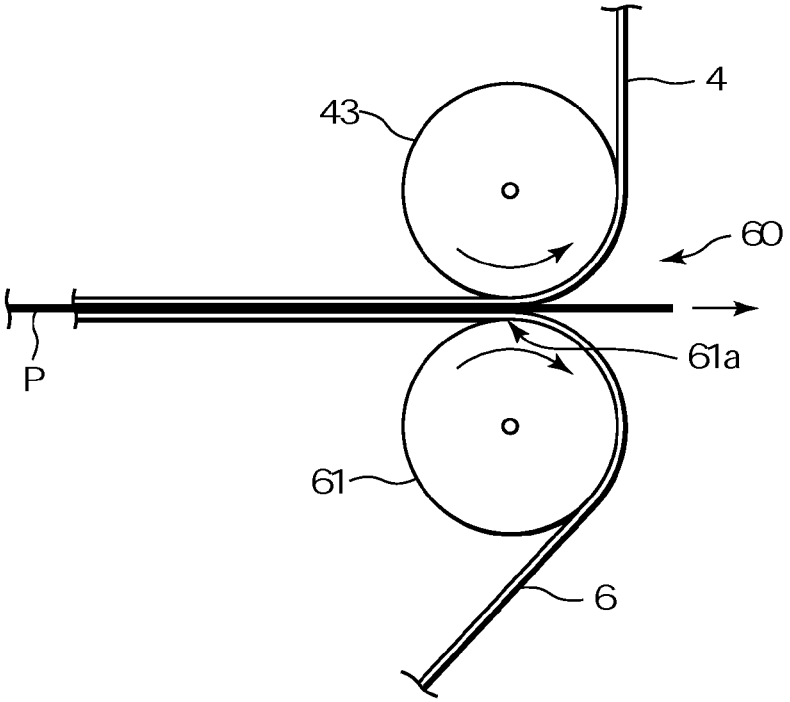

FIG. 7A - PRIOR ART
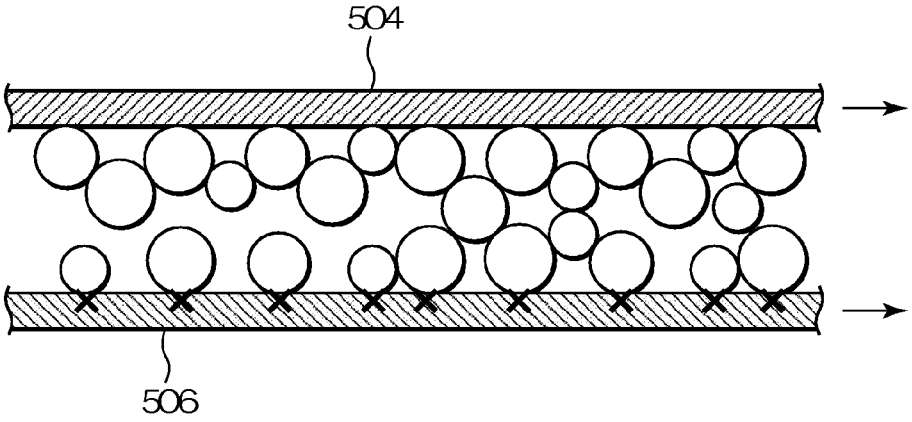
FIG. 7B
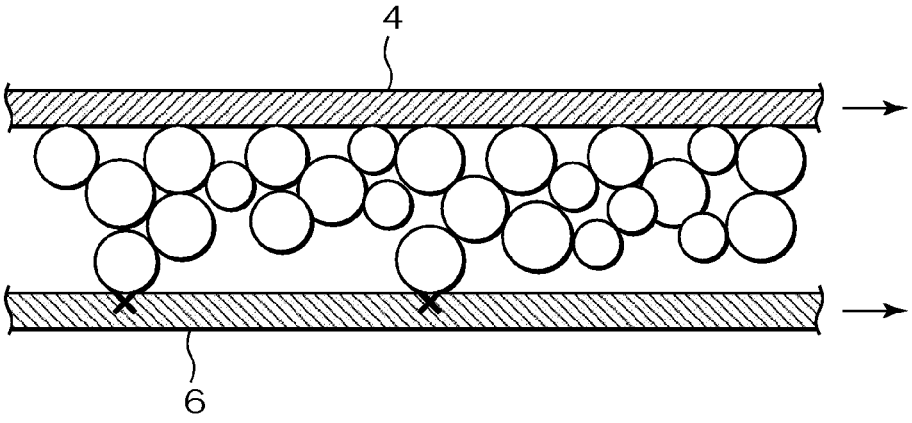

IMAGE FORMING APPARATUS USING A DEVELOPER IMAGE CARRIER MOVING IN A PREDETERMINED DIRECTION

CROSS-REFERENCE TO RELATED APPLICATION

This application claims priority under 35 U.S.C. §119 from Japanese Patent Application NO. P 2011-069417, filed on Mar. 28, 2011, the disclosure of which is incorporated herein by reference.

BACKGROUND OF THE INVENTION

1. Field of the Invention

This application relates to an image forming apparatus that forms an image on a sheet by transfer of a developer image held on a developer image carrier to the sheet, which is being carried in predetermined direction.

2. Description of the Related Art

In Japanese Laid-Open Patent No. 2010-134141, an image forming apparatus forms a developer image on a sheet by transfer the developer image formed on a developer image carrier onto the sheet. However, in this image forming apparatus, it might occur that a developer image on a developer image carrier is inaccurately transferred onto the sheet, and thus image quality may be degraded.

Therefore, a purpose of this application is to disclose an image forming apparatus that may increase image quality of a developer image transferred from a developer image carrier onto a sheet.

SUMMARY OF THE INVENTION

An object of the application is to disclose an image forming apparatus capable of increasing image quality.

According to one aspect, an image forming apparatus that transfers a developer image onto a sheet and forms the developer image on the sheet includes a developer image carrier, a first pressing member, a transfer member, a first voltage supply, and an adherence part. The developer image carrier holds a developer image and moves in a predetermined direction. The first pressing member presses against the developer image carrier from a side thereof opposite to a side thereof on which the developer image is held. The transfer member is arranged against the first pressing member through the developer image carrier. The first voltage supply supplies a voltage that is applied between the first pressing member and the transfer member to transfer the developer image on the developer image carrier in a direction from the developer image carrier toward the transfer member. The adherence part adheres the sheet to the developer image carrier upstream of the first pressing member in the predetermined direction.

BRIEF DESCRIPTION OF THE DRAWINGS

The image forming apparatus will be more fully understood from the following detailed description with reference to the accompanying drawing, which is given by way of illustration only, and is not intended to limit the invention, wherein:

FIG. 6A is a view illustrating a problem occurring in a first comparative example;

FIG. 6B is a view illustrating why the problem of the first comparative example does not occur in the first embodiment of the invention;

FIG. 7A is a cross-sectional view illustrating schematically a toner image held on an intermediate transfer belt upstream of transfer nip in a second comparative example;

FIG. 7B is a cross-sectional view illustrating schematically a toner image held on the intermediate transfer belt upstream of transfer nip according to the first embodiment;

DETAILED DESCRIPTION OF THE INVENTION

First Embodiment

Figure 1:
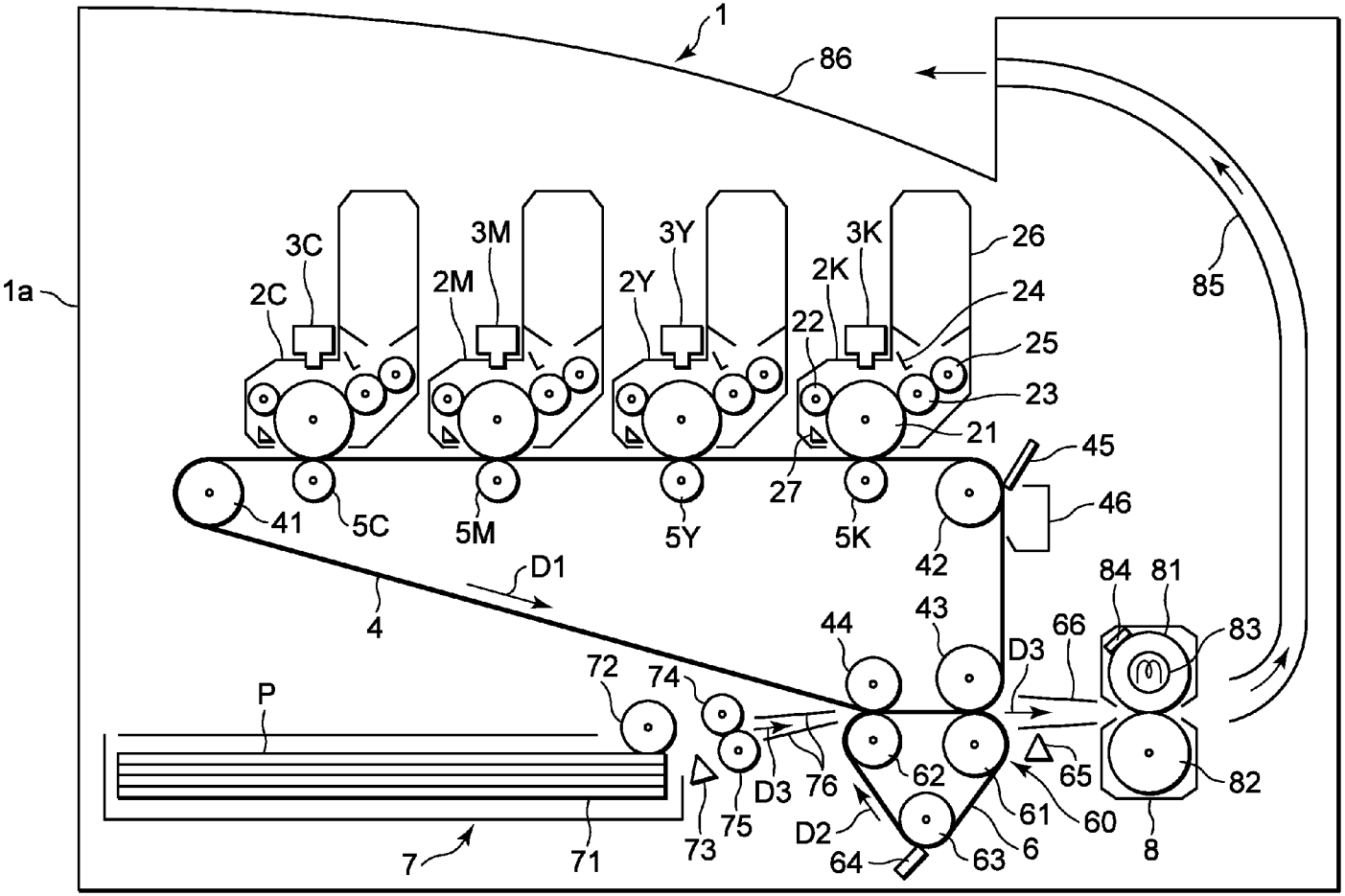
FIG. 1 is a vertical cross-sectional view illustrating schematically the structure of a color printer as a first embodiment of the image forming apparatus according to the invention.

FIG. 1 is a vertical cross-sectional view that illustrates schematically the structure of a color printer 1*a* (a color image recording apparatus) as a first embodiment of an image forming apparatus 1 according to the invention. The image forming apparatus 1 according to the first embodiment may serve as a tandem-type color LED printer. However, the image forming apparatus 1 that may be applied this embodiment may include another apparatus that adopts an electrophotographic system, such as a copy machine, a facsimile, a multi function printer, or a monochrome printer.

As shown in FIG. 1, the image forming apparatus 1 includes image forming units 2K, 2Y, 2M, and 2C, LED heads 3K, 3Y, 3M, and 3C, and an intermediate transfer belt 4 as a developer image carrier. The image forming units 2K, 2Y, 2M, and 2C form respectively images of Black (B), Yellow (Y), Magenta (M), and Cyan (C). The LED heads 3K, 3Y, 3M, and 3C serve as an exposure device, and expose based on information of the Black, Yellow, Magenta, and Cyan content of the image. The intermediate transfer belt 4 serves as an intermediate transcriptional endless body as a developer image carrier. Also, the image forming apparatus 1 includes transfer rollers 5K, 5C, 5M, and 5Y, a transfer belt 6 as a carrying member, a paper feed unit 7 (a sheet supply), and a fuser 8. The transfer rollers 5K, 5C, 5M, and 5Y transfer a toner image from the respective upper photoreceptor in the image forming units 2K, 2Y, 2M, and 2C to the intermediate transfer belt 4. The transfer belt 6 provides a transfer of a toner image as a developer image held on the intermediate transfer belt 4. The paper feed unit 7 supplies sheets P each in turn. The fuser 8 fixes toner images transferred onto the successive sheets.

Basically, the image forming units 2K, 2Y, 2M, and 2C have the same inner structures. Therefore, the image forming unit 2K will be described as an example. As shown in FIG. 1, the image forming unit 2K includes a photoreceptor 21, a charging roller 22 as a charging unit, a developing roller 23, a sponge roller 25, a developing blade 24, a toner cartridge 26, and a cleaning blade 27. The charging roller 22 transfers a uniform charge on the photoreceptor 21. The developing roller 23 develops an electrostatic latent image by using a toner as a developer. Here, the electrostatic latent image is formed on a surface of the photoreceptor 21 by the LED head 3K exposing uniformly the charged surface thereof. The sponge roller 25 frictionally charges negatively the toner supplied to the surface of the developing roller 23. The developing blade 24 assures that a toner supplied on the surface of the developing roller 23 forms a thin layer. The toner cartridge 26 stores the toner to be supplied to the sponge roller 25. The cleaning blade 27 clears toner that remains on the surface of the photoreceptor 21. The image forming units 2Y, 2M, and 2C, which store respectively a Yellow toner, a Magenta toner, and a Cyan toner, have the same structure as that of the image forming unit 2K that stores Black toner.

Also, the image forming apparatus 1 includes a drive roller 41, an idle roller 42, a transfer roller 43 as a pressing member, and a pre-nip transfer roller 44 as a pressing member. The intermediate transfer belt 4 is looped around the drive roller 41, the idle roller 42, the transfer roller 43, and the pre-nip transfer roller 44. The intermediate transfer belt 4 is moved in the direction D1 based on a drive mechanism formed for example by a motor rotating the drive roller 41 and carries with it a toner image. Also, transfer rollers 5K, 5Y, 5M, and 5C are respectively arranged against the respective photoreceptors 21 of the image forming units 2K, 2Y, 2M, and 2C, across the intermediate transfer belt 4. A toner image of each color formed respectively on each photoreceptor 21 is transferred onto the intermediate transfer belt 4 by a transfer bias voltage applied to the transfer roller 5K, 5Y, 5M, and 5C. Then, the toner images of the respective colors are lapped over one another on the intermediate transfer belt 4, thereby to form a complete color toner image. The toner image held on the intermediate transfer belt 4 is carried in the direction D1 by the intermediate transfer belt 4, to a transfer unit 60 (to be described below with reference to FIG. 3). In FIG. 1, a cleaning blade 45 cleans toner on the intermediate transfer belt 4, and a waste toner storage 46 stores the toner cleaned by the cleaning blade 45.

Also, the image forming apparatus 1 includes a transfer roller 61 as a transfer member, a pre-nip transfer roller 62 as an auxiliary member, a cleaning roller 63, and a cleaning blade 64. The pre-nip transfer roller 62 is arranged upstream of the transfer roller 61 in the direction D3 in which the sheet is being carried. The cleaning roller 63 holds the transfer belt 6 against the cleaning blade 64. The transfer belt 6 is lapped around the transfer roller 61, the pre-nip transfer roller 62, and the cleaning roller 63. The transfer belt 6 is moved in the direction D2 based on the driving force of a driving mechanism such as a motor rotating any one of the three rollers 61, 62 and 63. Also, the image forming apparatus 1 includes a carrier sensor 65 that detects each sheet P as it passes through the transfer unit 60, and a guide member 66 that directs the sheets.

Also, the image forming apparatus 1 includes a sheet storage cassette 71 that stores sheets, a hopping roller 72, a registration sensor 73, a registration roller 74, a pinch roller 75, and a guide member 76. Registration sensor 73 senses each sheet P taken out in turn from the sheet storage cassette 71 by the hopping roller 72, as it reaches to a contact portion (a paper feeding nip) of the registration roller 74 and the pinch roller 75. The registration roller 74 sends each sheet P to a transfer nip 61*a* (see FIG. 3), when a toner image transferred first on the intermediate transfer belt 4 reaches the transfer nip 61*a*, so that the sheet P is moved to the transfer nip 61*a* overlapping with a toner image on the intermediate transfer belt 4. The sheet P is carried while nipped between the intermediate transfer belt 4 and the transfer belt 6, and a toner image on the intermediate transfer belt 4 is transferred onto the sheet P at the transfer nip 61*a* where the transfer roller 61 faces the transfer roller 43.

Also, the image forming apparatus 1 includes as part of the fuser 8 a heating roller 81, a pressure roller 82, a halogen heater 83 that may heat the heating roller 81 from within the heating roller 81, and a temperature detector 84. The pressure roller 82 is pressed against the heating roller 81 by a biasing member, such as a spring. The contacting portions of the pressure roller 82 and the heating roller 81 form a fusing nip. The halogen heater 83 is controlled based on the temperature detected by the temperature detector 84, to maintain the temperature of the heating roller 81 within predefined temperature range. When a sheet P having reached the fuser 8 passes through the fusing nip, the sheet P is heated and pressed so that the toner image transferred onto the sheet P is melted and fused to form a color image. The color image-bearing sheet P is guided onto a stacker 86 at the upper surface of the image forming apparatus 1. Also, it may be noted here that the configuration and placement of each structure of the image forming apparatus 1 is not limited to illustrated example.

Figure 2:
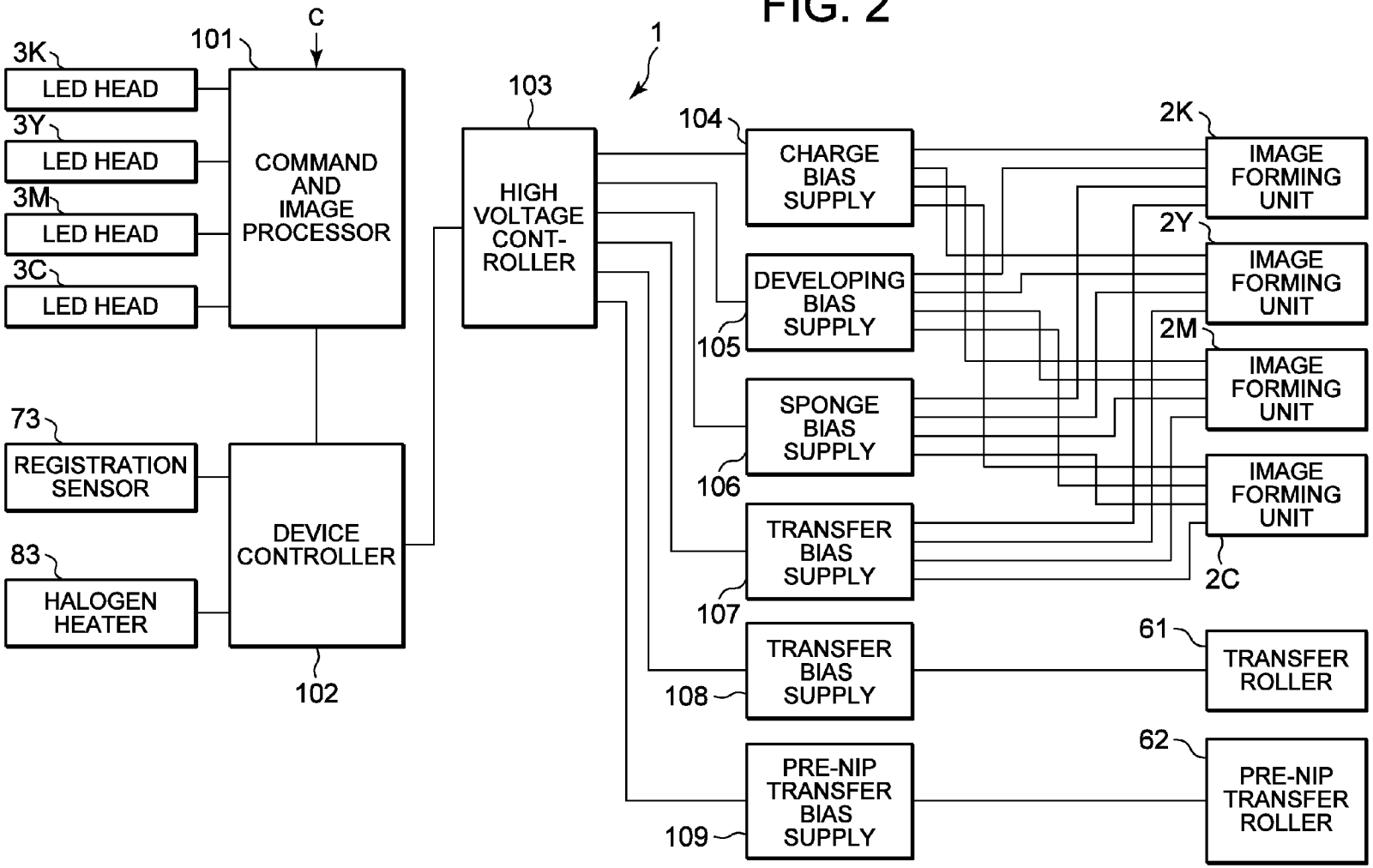
FIG. 2 is a block diagram illustrating schematically the structure of a control circuit of the color printer according to the first embodiment.

FIG. 2 is a block diagram that illustrates schematically an exemplary structure of a control circuit of the color printer 1*a*. As is shown in FIG. 2, the image forming apparatus 1 includes a command and image processor 101, a device controller 102, a high voltage controller 103, a charge bias supply 104, a developing bias supply 105, a sponge bias supply 106, a transfer bias supply 107, a transfer bias supply 108, and a pre-nip transfer bias supply 109. The command and image processor 101 handles command and image data C received from a host. The device controller 102 controls a device, such as the registration sensor 73, the halogen heater 83, and the high voltage controller 103, based on an order from the command and image processor 101.

The command and image processor 101 controls the general behavior of the image forming apparatus 1. Also, the command and image processor 101 analyzes input image data, expands the input data into bitmap data, and transmits the expanded image data to the LED heads 3K, 3Y, 3M, and 3C. The LED heads 3K, 3Y, 3M, and 3C emit light based on the respectively received image data.

The device controller 102 executes for example observations of the output power of the registration sensor 73, control of the halogen heater 83, and the direction of high voltage output power, to the high voltage controller 103. Also, the device controller 102 includes a flash memory, and an EEPROM (Electrically Erasable Programmable Read Only Memory) that store a control program and control each device based on the control program.

The high voltage controller 103 controls the charge bias supply 104, the developing bias supply 105, the sponge bias supply 106, the transfer bias supply 107, the transfer bias supply 108, and the pre-nip transfer bias supply 109. The charge bias supply 104 supplies respective developing bias voltages that are applied to the charge rollers 22 of the image forming units 2K, 2Y, 2M, and 2C. The developing bias supply 105 supplies respective developing bias voltages that are applied to the developing rollers 23 of the image forming units 2K, 2Y, 2M, and 2C. The sponge bias supply 106 supplies respective sponge bias voltages that are applied to the sponge rollers 25 of the image forming units 2K, 2Y, 2M, and 2C. The transfer bias supply 107 supplies respective transfer bias voltages that are applied to the transfer rollers 5K, 5Y, 5M, and 5C. The pre-nip transfer bias supply 109 supplies a pre-nip transfer bias voltage that is applied to the pre-nip transfer roller 44.

Figure 3:
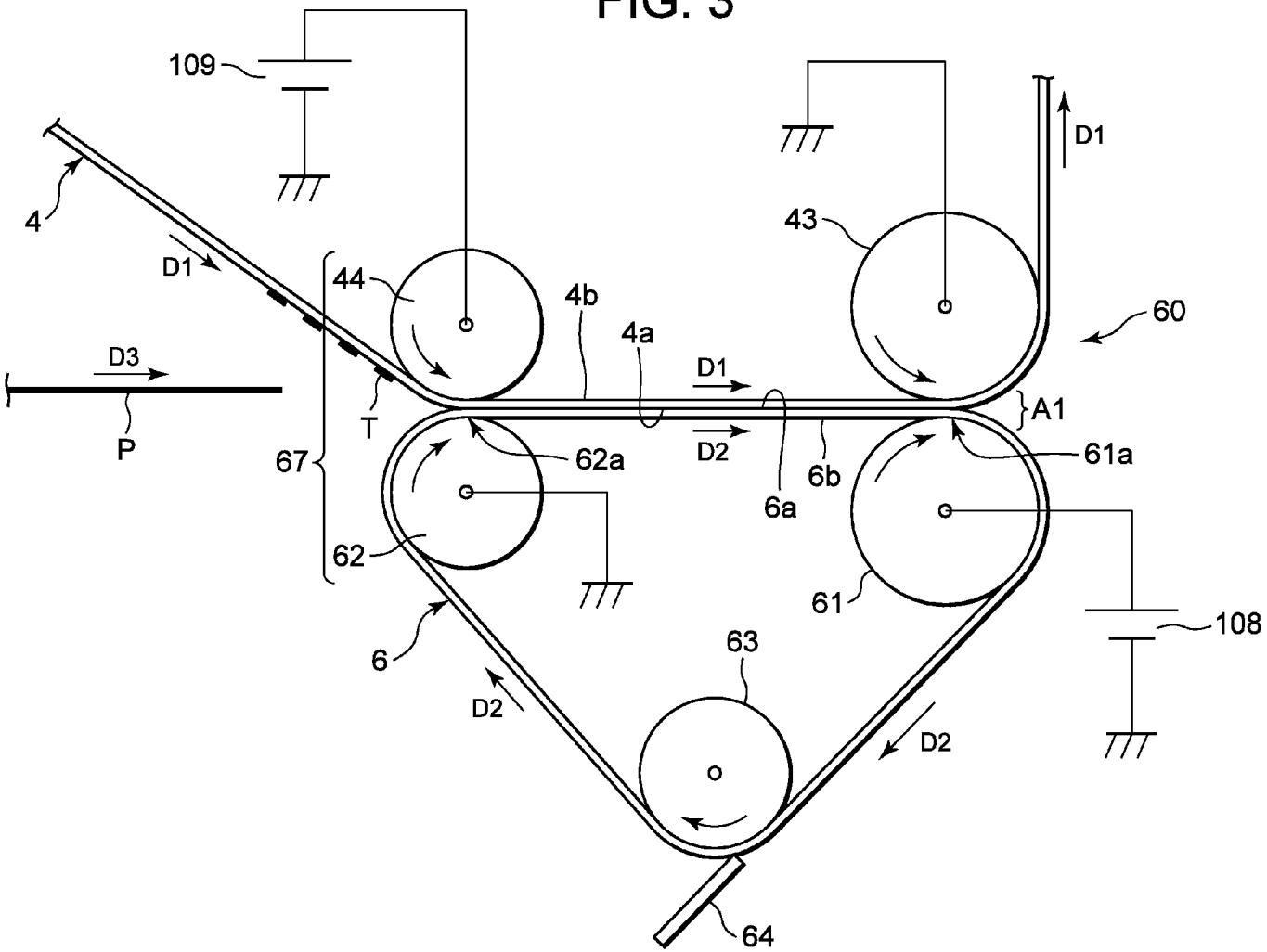
FIG. 3 is a schematic view of the transfer unit shown in FIG. 1.

FIG. 3 is a schematic view of the transfer unit 60 shown in FIG. 1. The transfer unit 60 includes the intermediate transfer belt 4, the transfer roller 43, the transfer roller 61, the transfer bias supply 108, the high voltage controller 103 that controls the transfer bias supply 108, and an adherence part 67.

The intermediate transfer belt 4 has an outside face 4*a* that holds a toner image T, and an inside face 4*b* (in FIG. 1) that is opposite to the outside face 4*a*. Also, the intermediate transfer belt 4 carries a toner image T held on the outside face 4*a*. The transfer roller 43 depresses the inside face 4*b* toward the transfer roller 61.

As shown in FIG. 3, a transfer part A1 is configured by the transfer roller 43, the intermediate transfer belt 4, the transfer roller 61, and the transfer belt 6. The transfer roller 61 is disposed opposite to the transfer roller 43 through the transfer belt 6 and the intermediate transfer belt 4. Also, the transfer roller 61 transfers a toner image T held on the outside face 4*a* onto a sheet P being carried in the direction D3. The transfer bias supply 108 supplies a transfer voltage that is applied between the transfer roller 43 and the transfer roller 61. The high voltage controller 103 controls the transfer bias supply 108 so that the toner image T is transferred by the transfer voltage from the outside face 4*a* onto a sheet P.

The adherence part 67 assures that a sheet P carried in the direction D3 along a moving route arranged between the intermediate transfer belt 4 and the transfer roller 61 adheres to the intermediate transfer belt 4 at a predetermined area just upstream of the transfer roller 43 in the direction D3. The direction D3 has the same moving direction as that of the intermediate transfer belt 4. In this embodiment, the adherence part 67 includes the intermediate transfer belt 4, the pre-nip transfer roller 44, the transfer belt 6, and the pre-nip transfer roller 62. The pre-nip transfer roller 44 is arranged upstream of the transfer roller 43 in the direction D3. The pre-nip transfer roller 62 is arranged upstream of the transfer roller 61 in the direction D3. The pre-nip transfer roller 62 contacts the pre-nip transfer roller 44 through the intermediate transfer belt 4 and the transfer belt 6.

The pre-nip transfer roller 44 depresses the inside face 4*b*. In this embodiment, the pre-nip transfer roller 44 presses the inside face 4*b* toward the pre-nip transfer roller 62 upstream of the transfer roller 43 in the direction D3.

The transfer belt 6 includes an outside face 6*a* that contacts the outside face 4*a*, and an inside face 6*b* that is opposite to the outside face 6*a*. A carrier route of a sheet P is configured between the outside face 4*a* and the outside face 6*a*. The transfer roller 61 contacts the inside face 6*b*.

The pre-nip transfer roller 62 presses against the inside face 6*b*. In this embodiment, the pre-nip transfer roller 62 presses the inside face 6*b* toward the pre-nip transfer roller 44. As a result, the pre-nip transfer roller 62 is disposed opposite to the pre-nip transfer roller 44 so that the pre-nip transfer roller 62 and the pre-nip transfer roller 44 press against each other across the intermediate transfer belt 4 and the transfer belt 6. A substantial pressure formed between the transfer roller 43 and the transfer roller 61 is required to increase transfer efficiency. However, preferably in a pressure part between the pre-nip transfer roller 62 and the pre-nip transfer roller 44, the pressure is relatively small so that an image is held on the intermediate transfer belt 4 and the toner image T does not become blurred. Therefore, it is preferred that the pressure formed between rollers 44 and 62 is smaller than that between rollers 43 and 61.

The transfer belt 6 is looped around the transfer roller 61, the pre-nip transfer roller 62, and the cleaning roller 63, and moves in the direction D2. The transfer roller 61 is disposed against the transfer roller 43, and is pressed toward the pre-nip transfer roller 44 in a predetermined pressure through the transfer belt 6 and the intermediate transfer belt 4. Therefore, the intermediate transfer belt 4 contacts the transfer belt 6 in the area (a pre-nip area) from a first position (the transfer nip 61*a*) where the transfer roller 61 faces the transfer roller 43 to a position (a pre-nip starting position 62*a*) where the pre-nip transfer roller 62 faces the pre-nip transfer roller 44.

Also, in this embodiment, as shown in FIG. 3, the transfer roller 61 receives a positive electric potential from the transfer bias supply 108. The transfer roller 43 and the pre-nip transfer roller 62 are connected to ground. The pre-nip transfer roller 44 receives a positive electric potential from the pre-nip transfer bias supply 109.

Figure 4:
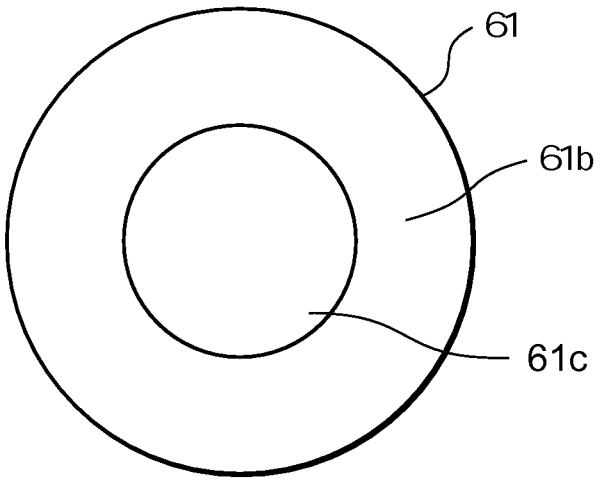
FIG. 4 is a schematic cross-sectional view of the transfer roller shown in FIG. 3.

FIG. 4 is a schematic cross-sectional view of the transfer roller shown in FIG. 3. As shown in FIG. 4, the transfer roller 61 includes a metallic shaft 61*c* with a foam rubber layer (sponge layer) 61*b* arranged around it. The foam rubber layer 61*b* is elastic and is formed by a conductive material having a predetermined volume resistance.

Figure 5:
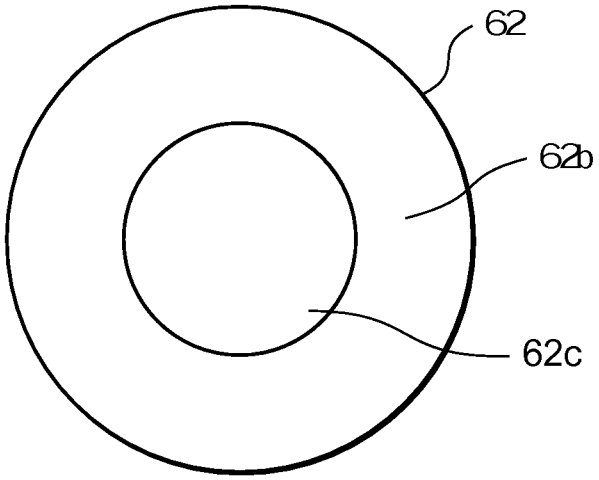
FIG. 5 is a schematic cross-sectional view of the pre-nip transfer roller shown in FIG. 3.

FIG. 5 is a schematic cross-sectional view of the pre-nip transfer roller 62 illustrated in FIG. 3. As shown in FIG. 5, the pre-nip transfer roller 62 includes a metallic shaft 62*c* with the foam rubber layer 62*b* arranged around it. The foamed rubber layer 62*b* is elastic and is formed of conductive material having a predetermined volume resistance.

FIG. 6A is a view illustrating a problem that occurs in a first comparative example. FIG. 6B is a view illustrating why the problem of the first comparative example does not occur in the first embodiment of the invention.

In a color printer 1*a* of an electro photographic system that adopts an intermediate transfer system, for instance, a color image is formed on a sheet in the following way. First each color toner image containing the colors Black, Yellow, Magenta, and Cyan is transferred onto a sheet in two transfers. That is, in a first transfer, colors of color toner image are transferred from the respective color photoreceptors that form the color developer image (a toner image) onto an intermediate transfer belt, with the color toner images for the different colors overlapping. Then, in a transfer, the composite toner image held on the intermediate transfer belt is transferred onto a sheet. As shown in FIG. 6A, the transfer unit 460 that executes the transfer includes an intermediate transfer belt 404, a transfer roller 443 entraining the intermediate transfer belt 404, a transfer belt 406 that contacts the intermediate transfer belt 404, and a transfer roller 461 entraining the transfer belt 406. The transfer roller 461 is arranged against the transfer roller 443 through the intermediate transfer belt 404 and the transfer belt 406. For instance, the transfer roller 461 is configured by a metallic shaft with a sponge layer arranged around it. The transfer roller 461 is pressed against the transfer roller 443 with a predetermined pressure through the transfer belt 406 and the intermediate transfer belt 404. A transfer nip 461*a* is formed where the transfer belt 406 abuts the intermediate transfer belt 404. In the transfer nip 461*a*, a sheet P is carried while sandwiched between the transfer belt 406 and the intermediate transfer belt 404, and a charging toner image T held on the intermediate transfer belt 404 is moved onto the sheet P based on a function of a transfer electric field created by a voltage applied to the transfer nip 461*a*.

However, the transfer nip 461*a* is formed by the transfer belt 406, the intermediate transfer belt 404, and a pair of rollers (the transfer roller 461 and the transfer roller 443) that are pressed against each other while sandwiched between them the transfer belt 406 and the intermediate transfer belt 404. Therefore, when a sheet P passes through the transfer nip 461*a*, a clearance gap 460*a* like shown in FIG. 6A occurs between the sheet P and the intermediate transfer belt 404 upstream of the transfer nip 461*a* in the direction. Also, a transfer electric field is created in the clearance gap 460*a* by a transfer voltage applied to the transfer nip 461*a*. If the transfer electric field is created in the clearance gap 460*a*, a charging polarity of a toner image T on the intermediate transfer belt 404 is momentarily reversed by an electrical discharge. This may cause a poor transfer to occur, such as a failure to transfer a part of a toner image T held on the intermediate transfer belt 404 onto a sheet P. As a result, a poor image portion, such as a blur or a white spot is produced in an image formed on the sheet P.

Also, in the image forming apparatus 1 of FIG. 6A, a toner image T that should be moved from the intermediate transfer belt 404 onto a sheet P at the transfer nip 461*a* could begin to be transferred to a sheet P before the toner image T reaches the transfer nip 461*a*. Therefore, toner of an image is scattered, and the image formed on the sheet P loses a clear boundary.

In contrast to this, in the case of the image forming apparatus 1 shown in FIG. 6B, the clearance gap 460*a* is not likely to occur as a result of the adherence part 67 shown in FIG. 3. Therefore, a transfer electric field is not likely to occur right beside, and just upstream of the transfer nip 61*a*, and it has less incidence of an electrical discharge. Also, there may be not a clearance gap at right beside and an upper stream just upstream of the transfer nip 61*a* is not likely to occur, and a transfer electric field likewise is likely not to occur. Therefore, a toner image T is moved from the intermediate transfer belt 4 onto the sheet P at the transfer nip 61*a* using a transfer electric field. The transfer nip 61*a* is the place where a transfer should be executed. In this way, in the image forming apparatus 1, the clearance gap 460*a* is not likely to occur. Therefore, it becomes possible to prevent an electrical discharge by a transfer electric field, and scattering of toner, and to the increase quality of an image transferred onto a sheet P.

Operations of the image forming apparatus 1 will be described. First, a general printing operation will be described. If the image forming apparatus 1 receives image printing data, the image forming apparatus 1 starts an image forming process. The device controller 102 controls the halogen heater 83, so that the temperature of the heating roller 81 of the fuser 8 is within a predetermined temperature range in which a toner image T is fused on the sheet P. If the heating roller 81 is within the predetermined temperature range after heating, the device controller 102 starts driving the drive roller 41 and each of the image forming units 2K, 2Y, 2M, and 2C. In parallel with this control, the device controller 102 orders the high voltage controller 103 to turn on the charge bias supply 104, the developing bias supply 105, and the sponge bias supply 106, and to supply respective high bias voltages to the image forming units 2K, 2Y, 2M, and 2C.

Next, an example of a process of forming a toner image with the image forming unit 2K on the photoreceptor 21 will be described. For instance, a −1000 V charge bias is supplied to the charge roller 22, and a surface of the photoreceptor 21 is charged to −600 V. Also, for instance, a −200 V developing bias voltage is supplied to the developing roller 23, and a −250 V sponge bias voltage is supplied to the sponge roller 25. Toner supplied from the toner cartridge 26 to a toner storage unit is negatively charged by strong friction between the sponge roller 25 and the developing roller 23. The toner when negatively charged is attached to the developing roller 23 by a potential difference between the sponge bias voltage and the developing bias voltage. The toner forms a layer of uniform thickness, attached the developing roller 23. With rotation of the developing roller 23, the toner layer is carried to the nip area between the photoreceptor 21 and the developing roller 23 by rotating of the developing roller 23.

The command and image processor 101 exposes a surface of the photoreceptor 21 of the image forming unit 2K by activating the LED head 3K. The voltage on the exposed part, for instance, is reduced −50 V, and an electrostatic latent image is formed there. The electrostatic latent image is carried to the nip area between the developing roller 23 and the photoreceptor 21 by rotating of the photoreceptor 21. A developing voltage of V, for instance, into −200 is applied to the developing roller 23. Therefore, a negatively charged toner is attached only to an electrostatic latent image part (the part from which charge has been removed) of the photoreceptor 21 by a potential difference, and a toner image thereby may be formed. Also, in the image forming units 2Y, 2M, and 2C, a toner image is formed respectively on the photoreceptor 6Y, 6M, and 6C by the same process as those performed by the image forming unit 2K, as described above.

When each color toner image is formed respectively on the photoreceptors 21 of the image forming units 2K, 2Y, 2M, and 2C, the high voltage controller 103 turns on the transfer bias supply 107 to apply respective transfer bias voltages to the transfer rollers 5K, 5Y, 5M, and 5C before the color toner images reach the contact portion between the photoreceptors 21 of the image forming units 2K, 2Y, 2M, and 2C and the intermediate transfer belt 4. Then the color toner images formed respectively on the image forming units 2K, 2Y, 2M, and 2C are transferred onto the intermediate transfer belt 4 so as to overlap each other.

When a first transfer of a toner image onto the intermediate transfer belt 4 is started, the device controller 102 controls the hopping roller 72 so that the hopping roller 72 is driven with predetermined timing to carry a sheet P from the sheet storage cassette 71, and to carry the sheet P to a contact portion (a paper feeding nip) of the registration roller 74 and the pinch roller 75. In addition, the device controller 102 controls the registration roller 74 so that the registration roller 74 is driven in synchronization with a toner image on the intermediate transfer belt 4 reaching the transfer nip 61*a* to carry the sheet P to the transfer nip 61*a* by a driving device, such as a motor. A sheet P is carried along a route between the intermediate transfer belt 4 and the transfer belt 6 in a pre-nip area, and is carried to the transfer nip 61*a*. While a sheet P is carried along the route, the sheet P overlaps a toner image T disposed on the intermediate transfer belt 4. The device controller 102 turns on the transfer bias supply 108 to apply the transfer bias voltage to the transfer roller 61, and turns on the pre-nip transfer bias supply 109 to apply the pre-nip transfer bias voltage to the pre-nip transfer roller 44. However, the pre-nip transfer bias voltage need not be applied to the pre-nip transfer roller 44, that is, the pre-nip transfer roller 44 is a ground potential.

Next, high voltage bias control of the transfer unit 60 in the image forming apparatus 1, and a device to execute the transfer by this control will be described. FIG. 7A is a cross-sectional view illustrating schematically a toner image held on an intermediate transfer belt 4 upstream of the transfer nip 61*a* in a comparative example. FIG. 7B is a cross-sectional view illustrating schematically a toner image held on the intermediate transfer belt 4 upstream of the transfer nip 61*a*.

For instance, a pre-nip transfer bias voltage +1.0 kV is supplied, and an electrical field that has an electrical field direction from the pre-nip transfer roller 44 toward the pre-nip transfer roller 62 is formed. A charging polarity of a toner that configures a toner image T is negative. Therefore, the toner receives a coulomb force that bears toward the intermediate transfer belt 4 from an electric field based on a pre-nip transfer bias voltage, and is pulled toward the intermediate transfer belt 4. As a result, as shown in FIG. 7B, the toner is carried to the transfer nip 61*a* attached strongly to the intermediate transfer belt 4, and is less attracted to a side of a sheet P. In this way, if a predetermined voltage is applied as a pre-nip transfer bias voltage, the adherence part 67 prevents a problem of a gap in a toner image held on the intermediate transfer belt 4 that will occur before a sheet P reaches the transfer nip 61*a*.

As shown in FIG. 7A, if a pre-nip transfer bias voltage is not applied, a certain amount of toner attaches to a side of a sheet P when the sheet reaches the pre-nip starting position (62*a* in FIG. 3) between the pre-nip transfer roller 62 and the pre-nip transfer roller 44. If a sheet P that has toner thereon is carried while sandwiched between the intermediate transfer belt 504 and the transfer belt 506, toner on the sheet P is disturbed by an imperceptible speed error, the toner image is transferred incorrectly, and image quality thereby drop. In the first embodiment, as shown in FIG. 7B, a force that pulls the toner to the intermediate transfer belt 4 causes a gap in a toner image at a pre-nip area to be reduced or eliminated.

Figure 8:
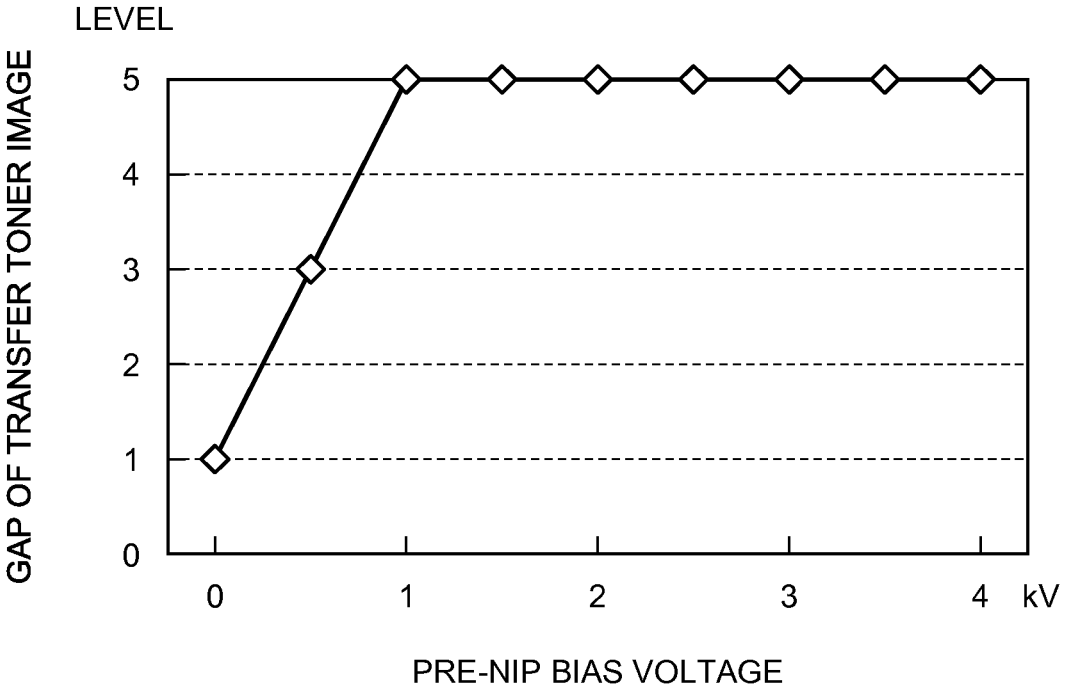
FIG. 8 is a diagram illustrating a relationship between a pre-nip bias voltage applied during a transfer, and a gap in the toner image, in the color printer of the first embodiment.

FIG. 8 is a diagram illustrating a relationship between a pre-nip bias voltage applied during the transfer, and a gap in the toner image, in the color printer 1*a* of the first embodiment. The amount of the gap was confirmed by a visual inspection. If a gap in the toner is predominant, the level shown in FIG. 8 is one (minimum level). If the gap in the toner does not occur, the level is five (maximum level). In addition, the levels 2, 3, and 4 are arranged in order of a major gap between levels one and five. Each level was decided respectively by visual inspections of images printed on respective sheets against a number of pre-nip transfer bias voltages, and by comparison with a baseline level. As a result, if a pre-nip transfer bias voltage of +1.0 kV or more is applied, a gap in the toner was shown be reduced.

In the image forming apparatus 1, almost all of the toner is pulled to the intermediate transfer belt 4 in a sandwiched area between the intermediate transfer belt 4 and the transfer belt 6. As a result, a gap in the toner that occurs before a sheet reaches the transfer nip 61*a* is prevented.

Next, a sheet P is carried to the transfer nip 61*a* between the transfer roller 61 and transfer roller 43 while sandwiched between the intermediate transfer belt 4 and the transfer belt 6. A +2.0 kV transfer bias, of which an absolute value is larger than a transfer pre-bias voltage, is supplied from the transfer bias supply 108, and an electric field directed from the transfer belt 6 toward the intermediate transfer belt 4 is formed. Since the charging polar character is negative, the toner is transferred to a sheet P by the electric field. In this way, since the toner that is to configure the toner image T is pulled to the intermediate transfer belt 4 strongly in a pre-nip area before the toner on the intermediate transfer belt 4 reaches the transfer nip 61*a*, a gap in the toner image before a transfer (onto a sheet), is prevented.

A sheet P is carried to the fuser 8 after passing through the transfer nip 61*a*. After the sheet reaches the fuser 8, it is carried while sandwiched between the heating roller 81, which has already reached a temperature range in which fusing is possible, and the pressure roller 82, while pressed against the heating roller 81, and a toner image is fused onto the sheet P. After the fusing, the sheet P is carried while guided by the guide member 85, and may be ejected onto the stacker 86, the printing operation having been completed.

In addition, the value of the pre-nip transfer bias supplied to the pre-nip transfer roller and the value of the transfer bias supplied to the transfer roller 61 are not limited to the examples described above.

Also, a pre-nip transfer bias voltage is applied to the pre-nip transfer roller 62 instead of the pre-nip transfer roller 44. In this case, the polarity of the voltage applied to the pre-nip transfer roller 62 is reversed relative to the polarity of a voltage applied to the pre-nip transfer roller 44.

Also, a transfer bias voltage is applied to the transfer roller 43 instead of the transfer roller 61. In this case, the polarity of a voltage applied to the transfer roller 43 has reversed polarity relative to the case of a voltage being applied to the transfer roller 61.

Also, in the above explanations, the case of a toner having a negative charging characteristic is described. However, the toner has a positive charging polarity. In this case, a bias voltage as the pre-nip transfer bias voltage is applied to the toner so that a coulomb force acts in the direction toward the intermediate transfer belt 4, and a bias voltage as a transfer bias voltage also is applied to the toner so that a coulomb force acts in the direction toward the transfer belt 6.

As described above, in the image forming apparatus 1, the adherence part 67 is arranged so that a sheet P contacts the intermediate transfer belt 4 in a predetermined area (a pre-nip area) just upstream of the transfer roller 43 in the direction D3, i.e., just upstream of the transfer nip 61*a* in the direction D3. Therefore, upstream of the transfer nip 61*a*, it is possible to prevent faint printing based on an electrical discharge, and scattering of toner based on a transfer (a pre-transfer) that sometimes will occur upstream of the transfer nip 61*a* in the direction D3, and it is possible to increase the quality of an image formed on a sheet. Here, faint printing is a phenomenon that includes charging polarity of a toner image T on the intermediate transfer belt 4 being reversed by an electrical discharge, a toner image held on the intermediate transfer belt 4 not being transferred onto a sheet P, i.e., a poor transfer, and as a result, a poorly printed part, such as print that is faint or a white spot, occurs in an image formed on the sheet P. Also, scattering of toner is a phenomenon wherein if there is a gap upstream of the transfer nip 61*a*, a toner image T that should be transferred originally from the intermediate transfer belt 4 to a sheet P at the transfer nip 61*a*, starts to be transferred before reaching to the transfer nip 61*a*.

Also, in the image forming apparatus 1, a bias voltage that is reversed in polarity relative to a charge polarity of a toner image T is applied to the pre-nip transfer roller 44, so the toner image T is pulled to the intermediate transfer belt 4 in a pre-nip area upstream of the transfer nip 61*a*. Therefore, it is possible to prevent a gap of toner that is likely to occur in a contact portion between the intermediate transfer belt 4 and the transfer belt 6. As a result, it is possible to increase the quality of an image formed on a sheet.

Second Embodiment

As described above, in an image forming apparatus 1 according to the first embodiment, it is possible to prevent a gap in a toner image T on the intermediate transfer belt 4 in the adherence part 67 (from the pre-nip starting position 62*a* to the transfer nip 61*a* in FIG. 3) of the transfer unit 60, by applying to the transfer roller 44 a bias voltage that has a reversed polarity relative to that of the charge of a toner image T. Also, it is possible to transfer a good toner image T onto a sheet P. However, in the image forming apparatus 1, it is desirable to apply a voltage to the pre-nip transfer roller 44, which increases cost because the structure becomes complex and additional structure is required. Therefore, in an image forming apparatus 200 according to a second embodiment, application of a voltage to the pre-nip transfer roller 44 is not executed, and a structure is included to prevent a gap in the toner image on the intermediate transfer belt 4. However, in the image forming apparatus 200, a voltage is applied to the pre-nip transfer roller 44 as in the first embodiment. In this case, it is possible to further reduce or reduce the likelihood of a gap in the toner on the intermediate transfer belt 4 even more.

Figure 9:
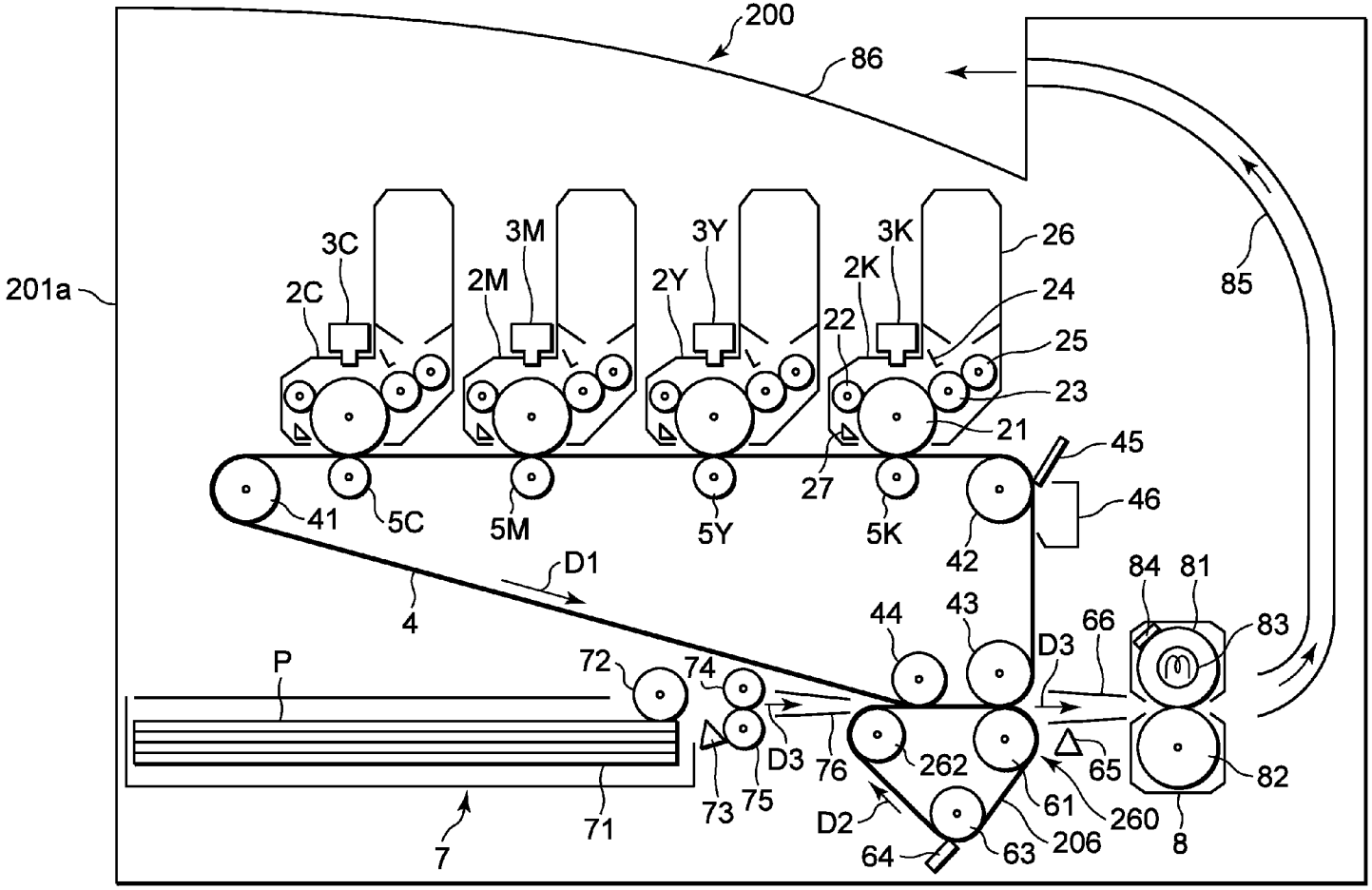
FIG. 9 is a vertical cross-sectional view illustrating schematically the structure of a color printer as a second embodiment of the image forming apparatus according to the invention.

FIG. 9 is a vertical cross-sectional view illustrating schematically the structure of a color printer 201*a* as the second embodiment of the image forming apparatus 200 according to the invention. In FIG. 9, elements that are the same as corresponding elements of the first embodiment shown in FIG. 1 are given the same reference characters. The image forming apparatus 200 differs from the image forming apparatus 1 in the structure of a transfer unit 260.

Figure 10:
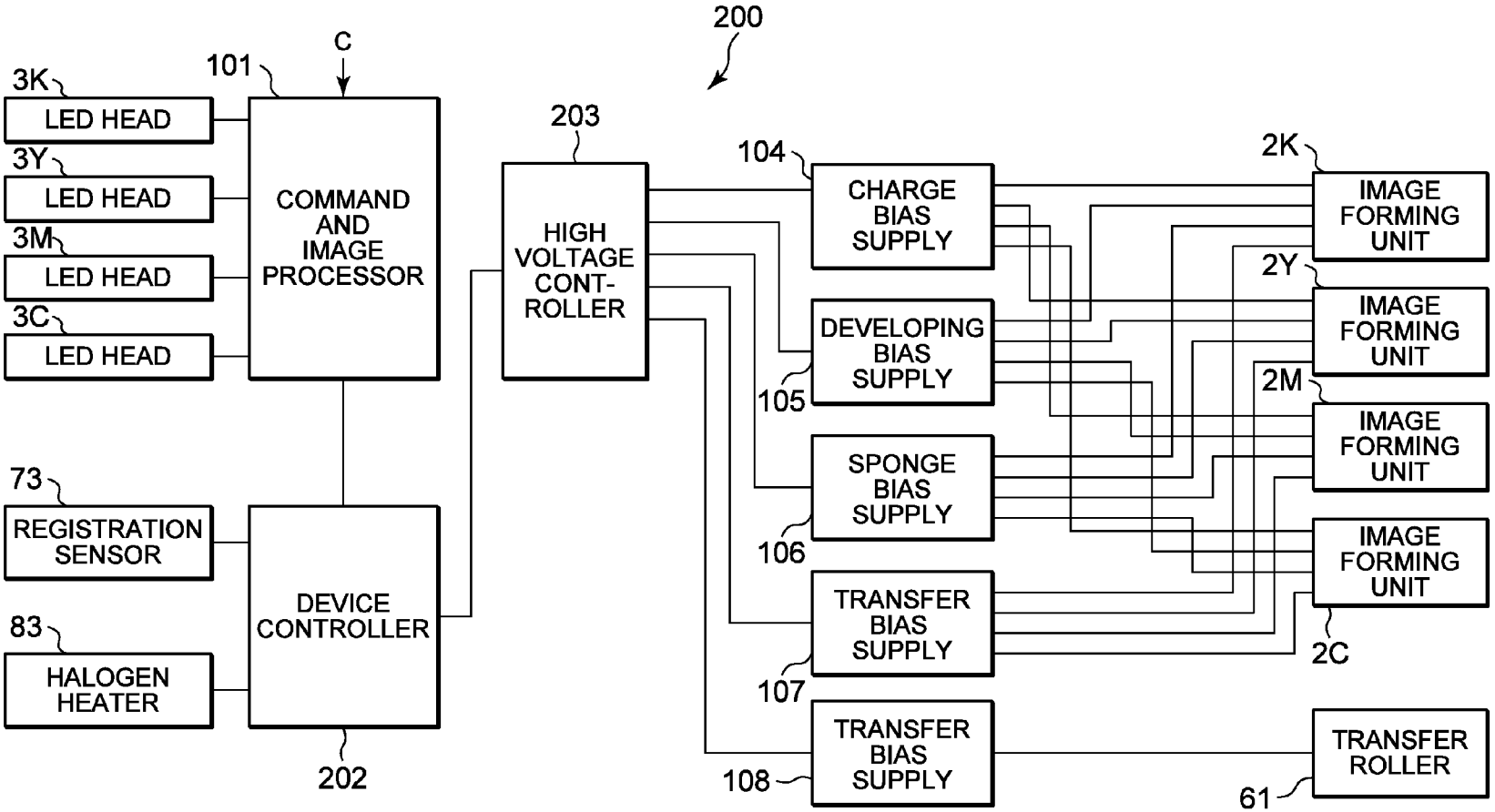
FIG. 10 is a block diagram illustrating schematically the structure of a control circuit of the color printer of the second embodiment.

FIG. 10 is a block diagram illustrating schematically an exemplary structure of a control circuit of the color printer 201*a*. In FIG. 10, elements that are the same as corresponding elements of the first embodiment shown in FIG. 2 are given the same reference characters. The image forming apparatus 200 differs from the image forming apparatus 1 in excluding the transfer pre-nip bias supply 109.

Figure 11:
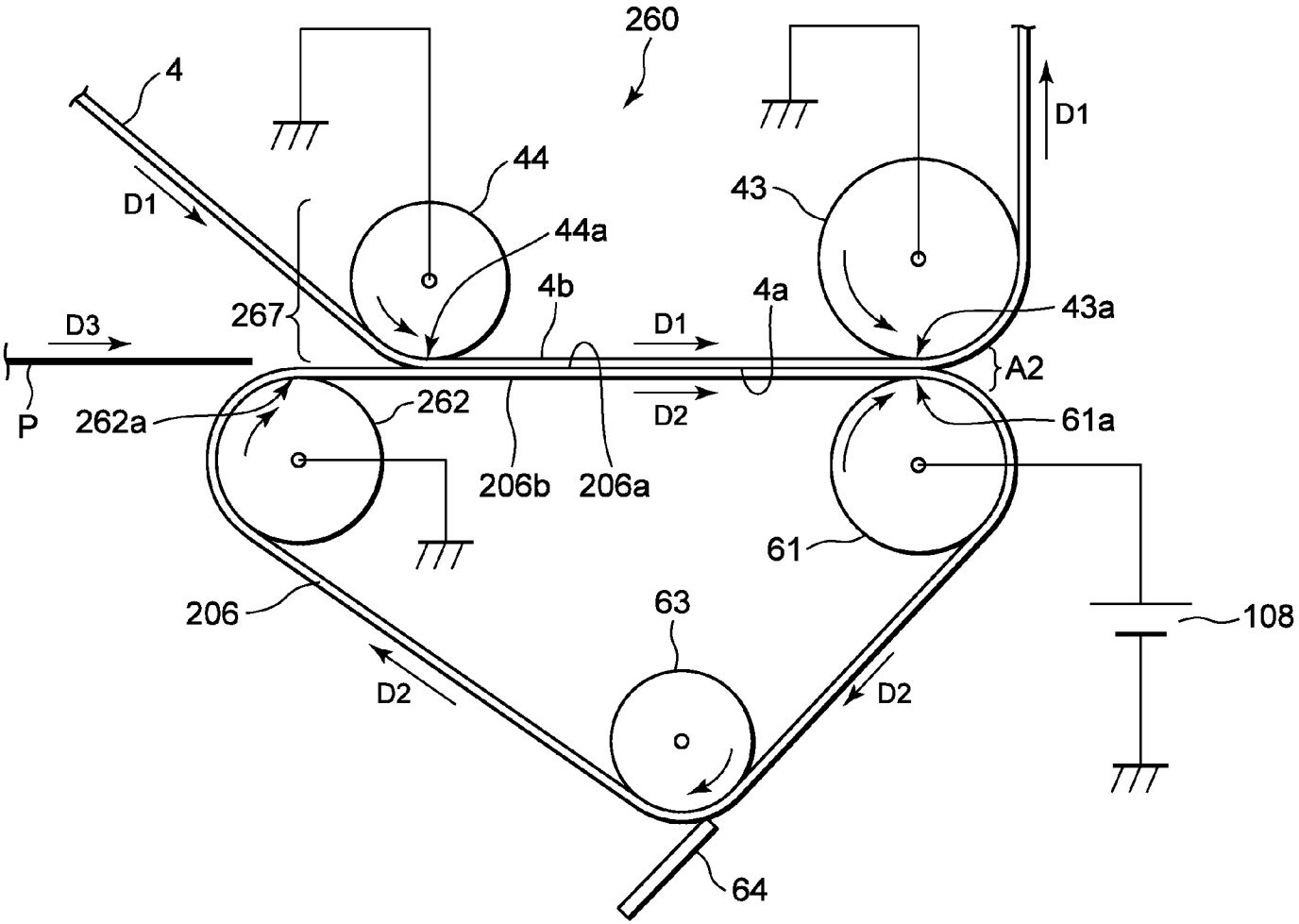
FIG. 11 is a schematic view of a transfer unit shown in FIG. 9.

FIG. 11 is a schematic view of the transfer unit 260 as shown in FIG. 9. The transfer unit 260 includes an intermediate transfer belt 4 as a developer image carrier, a transfer roller 43 as a first pressing member, a transfer roller 61 as a transfer member, a transfer bias supply 108, a high voltage controller 203 that controls the transfer bias supply 108, a transfer roller 262 as an auxiliary member, and an adherence part 267. The transfer roller 262 is arranged upstream of the transfer roller 61 in the direction D3.

As shown in FIG. 11, a transfer part A2 includes the intermediate transfer belt 4, the transfer roller 61, and a transfer belt 206 as a carrying member. The adherence 267 is arranged upstream of the transfer part A2 in the direction D3, and includes the pre-nip transfer roller 44, the transfer belt 206, and the intermediate transfer belt 4. The pre-nip transfer roller 44 is arranged upstream of the transfer roller 43 in the direction D1 that is the direction of movement of the intermediate transfer belt 4. Also, the pre-nip transfer roller 44 presses the intermediate transfer belt 4 from a side thereof opposite to the side on which the toner image is held. The transfer belt 206 is arranged from upstream of the transfer roller 61 in the direction D3 to the transfer roller 61. The pre-nip transfer roller 44 contacts the intermediate transfer belt 4. Also, the intermediate transfer belt 4 contacts the transfer belt 206, and the pre-nip transfer roller 44 depresses the transfer belt 206 through the intermediate transfer belt 4.

The adherence part 267 is arranged upstream of the transfer roller 43 in the moving direction D1 of the intermediate transfer belt 4. Also, the adherence part 267 includes the pre-nip transfer roller 44, an outside face 206*a* that contacts an outside face 4*a* of the intermediate transfer belt 4, and an inside face 206*b* that is disposed opposite to the outside face 206*a*. Also, the adherence part 267 configures a carrier route between the outside face 4*a* and the outside face 206*a*. The transfer roller 262 presses the inside face 206*b*. The pre-nip transfer roller 44 depresses the transfer belt 206 while sandwiching the intermediate transfer belt 4.

The transfer belt 206 is looped around the transfer roller 262, the transfer roller 61, and the cleaning roller 63. Also, the cleaning blade 64 is disposed opposite to the cleaning roller 63 through the transfer belt 206. The cleaning blade cleans toner attached on the outside face 206*a*. The transfer roller 61 connects the transfer bias supply 108, and a transfer bias voltage is supplied to the transfer roller 61. The outside face 206*a* contacts the outside face 4*a* at an entrained portion by the transfer roller 262 and the transfer roller 61. The intermediate transfer belt 4 is entrained by the pre-nip transfer roller 44 and the transfer roller 43. The pre-nip transfer roller 44 and the transfer roller 43 are electrically connected to ground.

In the second embodiment, a contact condition of the transfer belt 206 and the intermediate transfer belt 4 is different from that in the first embodiment. In particular the transfer roller 262 is arranged upstream of the pre-nip transfer roller 44 in the direction D3. Also, a contact starting position 44*a* where the intermediate transfer belt 4 is entrained around the pre-nip transfer roller 44, and a position 262*a* where the transfer belt 206 is entrained around the transfer roller 262 are set so as to be mismatched with each other, i.e., the transfer roller 262 and the pre-nip transfer roller 44 are arrange to prevent them from pressing directly toward, and against each other through the intermediate transfer belt 4 and the transfer belt 206.

Figure 12:
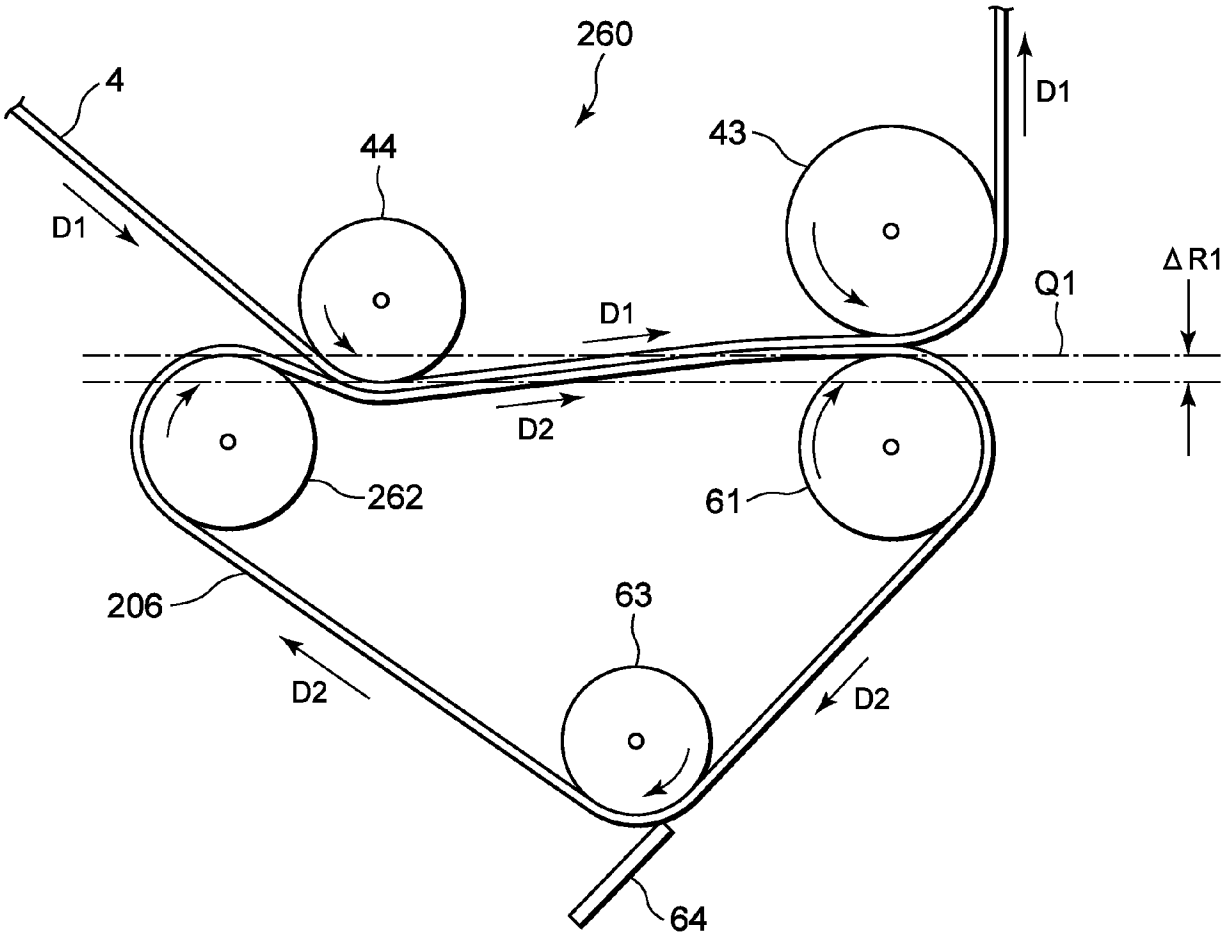
FIG. 12 is a schematic view of the transfer rollers and belts of the transfer unit according to FIG. 9.

FIG. 12 is a schematic view of the transfer rollers and belts of the transfer unit 260 according to FIG. 9. The pre-nip transfer roller 44 is arranged so as to press the transfer belt 206 no more than a distance ΔR1 from an external common tangent Q1 of rollers 61 and 262 toward a side of both the transfer roller 61 and the transfer roller 262.

Also, with the pre-nip transfer roller 44 pressing the transfer belt 206, the distance ΔR1, which is a limit on the lateral separation of the transfer belt 206 from the external common tangent Q1, allows for the range 0.0 mm≤ΔR1≤0.3 mm, and the range 0.0 mm≤ΔR1≤0.1 mm is preferred. Also, a value for ΔR1 of 0 mm is preferred in consideration of a drive load based on a pressure formed from the pre-nip transfer roller 44 on the intermediate transfer belt 4 and the transfer belt 206. However, if a manufacturing error or an assembly error occurs, it is difficult to keep the distance limit ΔR1 at 0 mm. Therefore, in this embodiment, a distance upper limit ΔR1 is set at 0.3 mm. The reason for such an upper limit at 0.3 mm is to prevent a front edge of a sheet from tipping up a toner image formed on the intermediate transfer belt 4, which may occur if the distance ΔR1 is more than 0.3 mm. If the thickness of a sheet is equal to or less than 0.3 mm (for example, a sheet thickness is 0.1 mm, 0.2 mm, or 0.3 mm), the range 0.0 mm≤ΔR1≤0.3 mm is recommended. However, if a thickness of a sheet is in the range 0.3 mm≤ΔR1≤0.8 mm (for example, a sheet thickness is 0.4 mm, 0.5 mm, 0.6 mm, 0.7 mm, or 0.8 mm), the range 0.0 mm≤ΔR1≤0.1 mm is recommended to avoid the tipping up of a top edge of a sheet.

Operations of the image forming apparatus 200 are the same as the operations of the image forming apparatus 1 except for the transfer operation. Therefore, the transfer operation now will be described.

A sheet taken from the sheet storage cassette 71 by a rotation of the hoping roller 72 is carried to the guide member 76. The direction in which a sheet P is being carried is toward the contact starting position 44*a* where the transfer belt 206 starts contacting the intermediate transfer belt 4 as directed by the guide member 76. Then the sheet is carried to the transfer unit 260. The sheet P is being carried to the position 43*a*, and 61*a* (at the transfer nip), where the transfer roller 61 faces the transfer roller 43, while sandwiched between the transfer belt 206 and the intermediate transfer belt 4. A device controller 202 turns on the transfer bias supply 108 to transfer a toner image T on the intermediate transfer belt 4 onto the sheet P based on the timing with which the sheet P reaches the transfer nip 61*a*. As with the image forming apparatus 200, for instance, the transfer bias voltage is 2.0 kV. Next, the sheet P is carried to the fuser 8 while sandwiched between the intermediate transfer belt 4 and the transfer belt 206. Then the sheet P is heated and pressed so that a toner image may be fused onto the sheet P.

A mechanism that executes a transfer in a satisfactory manner in the transfer unit 260 of the image forming apparatus 200 will be described. In the second embodiment, the transfer roller 262 and the pre-nip transfer roller 44 are arranged at positions so as to be mismatched with each other in the direction D3 to avoid their pressing directly toward, and against each other through the intermediate transfer belt 4 and the transfer belt 206. Therefore, a pressure applied to a sheet P between the intermediate transfer belt 4 and the transfer belt 206 in the second embodiment is relatively low as compared to pressure applied in the first embodiment. Also, it is possible that a sheet does not have a strong pressure locally applied to it, because the intermediate transfer belt 4 contacts the transfer belt 206 in a large area as compared to that in which a pair of opposing rollers press two belts against each other directly between the rollers, as for example is shown in FIG. 3. In addition, a sheet is sandwiched by the intermediate transfer belt 4 and the transfer belt 205, and does not have applied to it an electric field upstream of the transfer nip 61*a*. Under these conditions, as shown in FIG. 7B, only a portion of the toner on the intermediate transfer belt 4 contacts the sheet P, and most of that toner is not moved onto the sheet P. Therefore, even if an imperceptible speed error occurs as between the intermediate transfer belt 4 and the sheet P, it is possible to eliminate a gap in the toner on the intermediate transfer belt and a deterioration in the quality of the image.

As described above, in the image forming apparatus 200, the adherence part 267 is arranged in a predetermined area (a pre-nip area) just upstream of the transfer roller 43 in the direction D3 (i.e., just upstream of the transfer pre-nip 61*a*), so that a sheet P contacts the intermediate transfer belt 4. Therefore, it is possible to eliminate occurrence of a transfer blur based on an electrical discharge and a scattering of toner upstream of the transfer nip 61*a* in the direction D3.

Also, the image forming apparatus 200, the transfer roller 262 and the pre-nip transfer roller 44 are arranged respectively so as to avoid their pressing directly toward, and against each other across the intermediate transfer belt 4 and the transfer belt 206, so it is possible to prevent a sheet P from moving before a toner T on the intermediate transfer belt 4 reaches the transfer nip 61*a*. Therefore, it is possible to prevent the occurrence of a transfer blur based on an electrical discharge and a scattering of toner based on an incomplete transference of a developer image, by the adherence part 267 arranged upstream of the transfer nip 61*a*. Also, it is possible to prevent a gap from occurring in a toner image between the intermediate transfer belt 4 and the transfer belt 6. Also, it is possible to increase a quality of a toner image.

Third Embodiment

Figure 13:
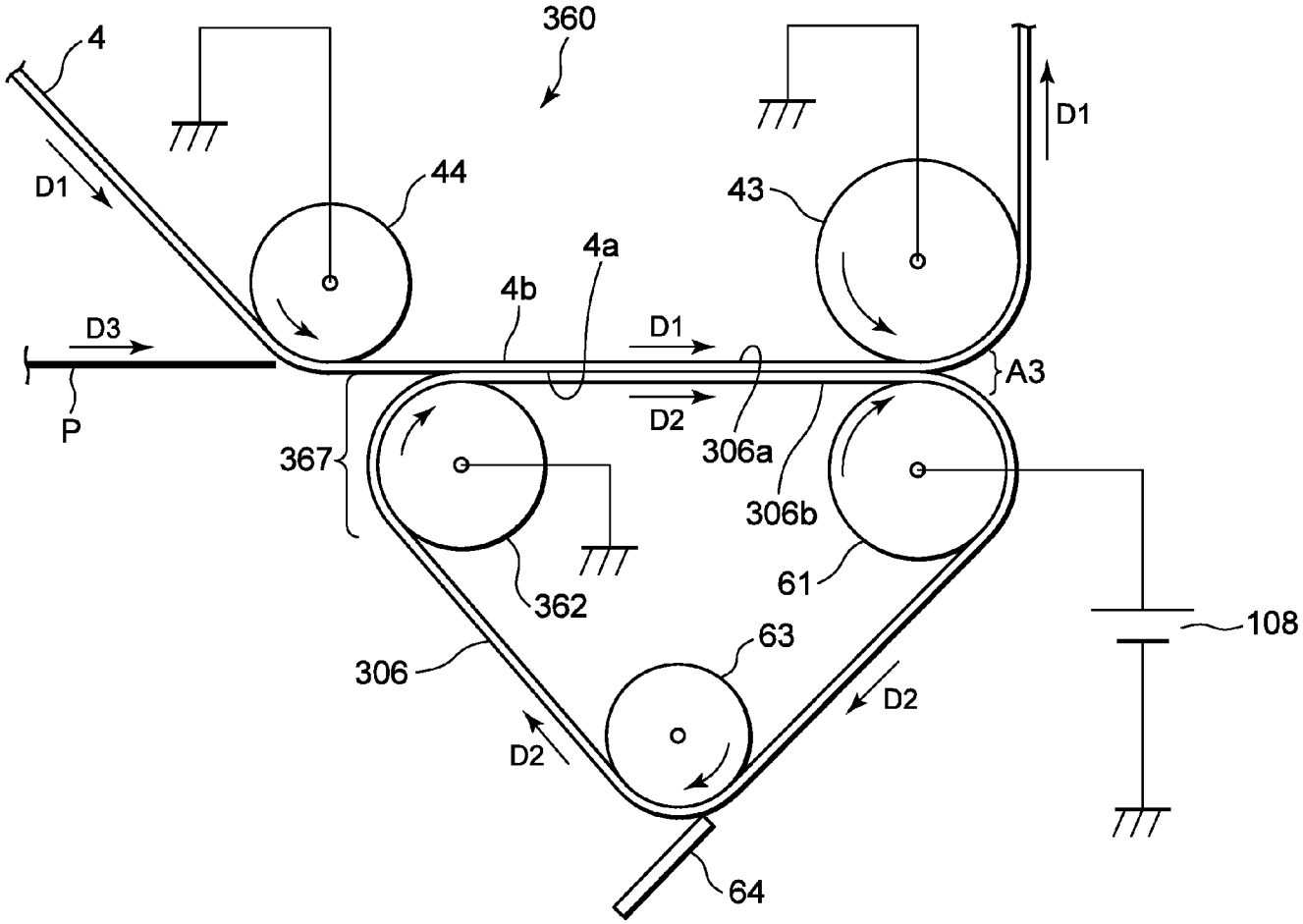
FIG. 13 is a view illustrating schematically a structure of a color printer as a third embodiment of the image forming apparatus according to the invention.

FIG. 13 is a view illustrating schematically the structure of a color printer according to a third embodiment of the image forming apparatus of the invention. In FIG. 13, elements that are the same as corresponding elements of the first embodiment and the second embodiment shown in FIG. 3 and FIG. 11 are given the same reference characters. As shown in FIG. 13, in a transfer unit 360, a pre-nip transfer roller 362 is arranged downstream of the transfer pre-nip roller 44 in the direction D3. Therefore, the transfer pre-nip roller 362 does not abut the transfer pre-nip roller 44 through an intermediate transfer belt 4 and a transfer belt 306 as a carrying member. This structure differs from those of the first and second embodiments.

In the image forming apparatus of the third embodiment, the transfer pre-nip roller 362 and the transfer pre-nip roller 44 are arranged so as to prevent them from pressing directly toward, and against each other through the intermediate transfer belt 4 and the transfer belt 306. Therefore, the pressure applied to a sheet P between the intermediate transfer belt 4 and the transfer belt 306 is less than the pressure applied to the sheet between the two belts 4 and 306 by the transfer pre-nip roller 362 and the transfer pre-nip roller 44, which press directly toward each other through the two belts 4 and 306. Also, the intermediate transfer belt 4 uniformly contacts the transfer belt 306 in a large area as compared to a roller pair pressing directly toward, and against each other. Therefore, it is possible to eliminate a locally strong pressure from being applied to a sheet.

As shown in FIG. 13, a transfer part A3 includes the transfer roller 43, the intermediate transfer belt 4, transfer roller 61, and transfer belt 306. An adherence part 367 is arranged upstream of the transfer part A3 in the direction D3. Also, the adherence part 367 includes the pre-nip transfer roller 362, the transfer belt 306, and the intermediate transfer belt 4. The pre-nip transfer roller 362 is arranged upstream of the transfer roller 61 in the direction D1 as the direction of movement of the transfer belt 306. Also, the pre-nip transfer roller 362 presses against the transfer belt 306 from an inside face 306*b* arranged opposite to an outside face 306*a* that is at a sheet moving side. The transfer belt 306 is arranged from upstream of the transfer roller 61 in the direction D3 to the transfer roller 61. The pre-nip transfer roller 362 contacts the transfer belt 306. The transfer belt 306 contacts the intermediate transfer belt 4. Also, the pre-nip transfer roller 362 presses against the intermediate transfer belt 4 through the transfer belt 306.

Figure 14:
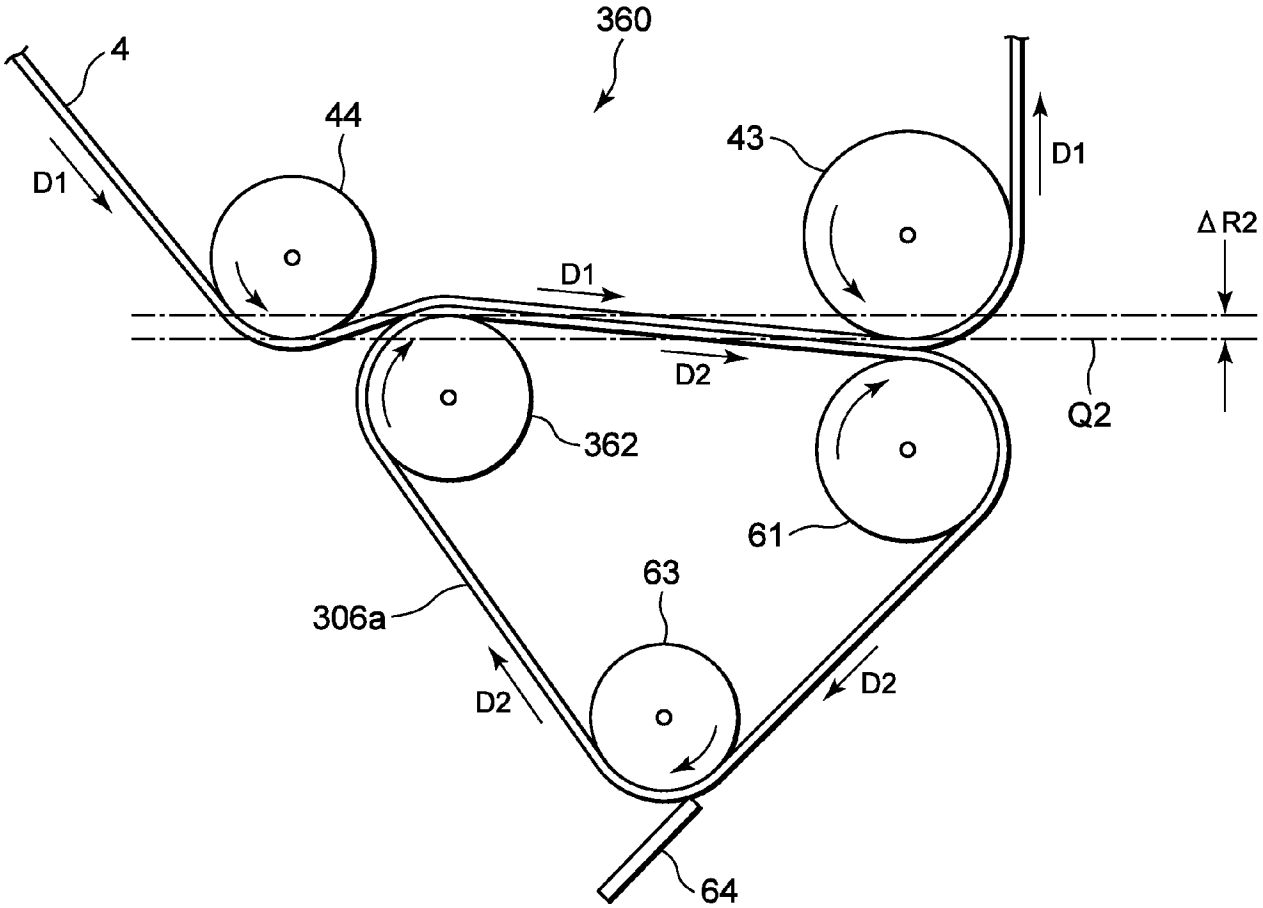
FIG. 14 is a schematic view of the transfer rollers and belts of the transfer unit according to FIG. 13.

FIG. 14 is a schematic view of the transfer rollers and belts of the transfer unit 360 according to FIG. 13. The pre-nip transfer roller 362 is arranged so as to press the intermediate transfer belt 4 no more than a distance ΔR2 toward a side of both the transfer roller 43 and the pre-nip transfer roller 44, so as to exceed an external common tangent Q2 to outer circumferences of rollers 43 and 44. The pressure applied by the pre-nip transfer roller 62 and the pre-nip transfer roller 44 to a sheet P between the intermediate transfer belt 4 and the transfer belt 306, is less than the pressure applied by the transfer roller 43 and the transfer roller 61 to the sheet P between the two belts.

For instance, as shown in FIG. 14, with the pre-nip transfer roller 362 pressing the intermediate transfer belt 4, the distance ΔR2, which is a limit on the lateral separation of the intermediate transfer belt 4 from the external common tangent Q1, allows for the range 0.0 mm≤ΔR2≤0.3 mm, and the range 0.0 mm≤ΔR2≤0.1 mm is preferred. Also, a value for ΔR2 of 0 mm is preferred in consideration of a drive load based on a pressure formed from the pre-nip transfer roller 362 on the intermediate transfer belt 4 and the transfer belt 306. However, if a manufacturing error or an assembly error occurs, it is difficult to keep the distance limit ΔR1 set at 0 mm. The reason for such an upper limit of 0.3 mm is to prevent a front edge of a sheet from tipping up a toner image formed on the intermediate transfer belt 4, which may occur if the distance ΔR2 is more than 0.3 mm. If the thickness of a sheet is equal to or less than 0.3 mm (for example, the sheet thickness is 0.1 mm, 0.2 mm, or 0.3 mm), the range 0.0 mm≤ΔR2Δ0.3 mm is recommended. However, if the thickness of the sheet is in the range 0.3 mm≤ΔR2 0.8 mm (for example, the sheet thickness is 0.4 mm, 0.5 mm, 0.6 mm, 0.7 mm, or 0.8 mm), the range 0.0 mm≤ΔR2 0.1 mm is recommended to avoid the tipping up of a top edge of a sheet.

The color printer of the third embodiment has the same structure as that of the second embodiment except as described above.

What is claimed is:

1. An image forming apparatus that transfers a developer image onto a sheet and forms the developer image on the sheet, comprising:

a developer image carrier configured to hold a developer image and move in a predetermined direction;

a first pressing member configured to press against the developer image carrier from a side thereof opposite to a side thereof on which the developer image is held;

a transfer member arranged against the first pressing member through the developer image carrier, said first pressing member and said transfer member being responsive to a first voltage applied therebetween to transfer the developer image from the developer image carrier toward the transfer member; and an adherence part configured to adhere a sheet to the developer image carrier upstream of the first pressing member in the predetermined direction, the adherence part including:

a second pressing member arranged upstream of the first pressing member in the predetermined direction and configured to press the developer image carrier from said side thereof opposite to the side thereof on which the developer image is held, an auxiliary member arranged upstream of the transfer member in the predetermined direction, and a carrying member arranged between the transfer member and the auxiliary member and configured to carry the sheet therewith in the predetermined direction, wherein the auxiliary member presses the second pressing member through the developer image carrier and the carrying member, the first pressing member presses the transfer member through the developer image carrier, and a pressure formed between the auxiliary member and the second pressing member is less than a pressure between the first pressing member and the transfer member.

2. The image forming apparatus of claim 1, wherein the developer image carrier is a belt member that is looped around the first pressing member and the second pressing member.

3. The image forming apparatus of claim 1, wherein the carrying member is a belt member that is looped around the transfer member and the auxiliary member.

4. The image forming apparatus of claim 1, wherein the transfer member, the auxiliary member, and the second pressing member are formed by respective roller members, and the first pressing member is arranged so as to press the transfer member in a direction normal to a line tangent to the transfer member and the auxiliary member.

5. The image forming apparatus of claim 1, wherein the auxiliary member, the first pressing member, and the second pressing member are formed by respective roller members, and the auxiliary member is arranged so as to press the developer image carrier in a direction normal to a line tangent to the first and the second pressing members.

6. The image forming apparatus of claim 1, further comprising a first voltage applying means for applying the first voltage between the first pressing member and the transfer member, the adherence part further comprising a second voltage applying means for applying a second voltage to hold the developer image on the developer image carrier.

7. The image forming apparatus of claim 6, wherein the second voltage applying means applies the second voltage to the second pressing member.

8. An image forming apparatus that transfers a developer image onto a sheet and forms the developer image on the sheet, comprising:

a developer image carrier configured to hold a developer image and move in a predetermined direction;

a first pressing member configured to press against the developer image carrier from a side thereof opposite to a side thereof on which the developer image is held;

a transfer member arranged against the first pressing member through the developer image carrier, said first pressing member and said transfer member being responsive to a first voltage applied therebetween to transfer the developer image from the developer image carrier toward the transfer member;

an adherence part configured to adhere a sheet to the developer image carrier upstream of the first pressing member in the predetermined direction; and a first voltage applying means for applying the first voltage between the first pressing member and the transfer member, wherein the adherence part includes a second voltage applying means for applying a second voltage to hold the developer image on the developer image carrier, and a second pressing member arranged upstream of the first pressing member in the predetermined direction and configured to press the developer image carrier from the side thereof opposite to the side thereof on which the developer image is held, the second voltage applying means applies the second voltage to the second pressing member, and the first and second voltages have the same polarity.

9. The image forming apparatus of claim 8, wherein the first voltage is higher than the second voltage.

10. An image forming apparatus configured to transfer a developer image onto a sheet and to form the developer image on the sheet, comprising:

a developer image carrier configured to hold a developer image and move in a predetermined direction;

a transfer member arranged against the developer image carrier, pressing the sheet toward the developer image carrier with a first pressing force; and an adherence part configured to adhere the sheet to the developer image carrier with a second pressing force upstream of the transfer member in the predetermined direction, wherein the second pressing force is less than the first pressing force.

11. The image forming apparatus of claim 10, wherein the developer image carrier is a belt member.

12. The image forming apparatus of claim 11, further comprising:

a first pressing member arranged against the transfer member through the belt member, wherein the adherence part is arranged upstream of the transfer member in the predetermined direction, and further comprises a second pressing member arranged against the belt member.

13. The image forming apparatus of claim 10, wherein the adherence part includes:

an auxiliary member, wherein a first electric potential is applied to the transfer member to transfer the developer image from the developer image carrier toward the sheet, and a second electric potential different from the first electric potential is applied to the auxiliary member.

14. The image forming apparatus of claim 13, wherein the auxiliary member is arranged upstream of the transfer member in the predetermined direction, and is grounded.

15. The image forming apparatus of claim 13, wherein the second electric potential is applied to hold the developer image on the developer image carrier.

16. The image forming apparatus of claim 13, wherein the developer image carrier is a belt member.

17. The image forming apparatus of claim 16, wherein the auxiliary member is arranged upstream of the transfer member in the predetermined direction, and the adherence part further includes a pressing member arranged against the auxiliary member through the belt member.

18. The image forming apparatus of claim 10, further comprising:

a first pressing member arranged against the transfer member through the developer image carrier, wherein the adherence part includes:

a second pressing member arranged upstream of the first pressing member in the predetermined direction and configured to press the developer image carrier from said side thereof opposite to the side thereof on which the developer image is held, and a carrying member arrange from upstream of the transfer member in the predetermined direction to the transfer member and configured to contact the developer image carrier.

19. The image forming apparatus of claim 10, wherein the adherence part includes:

an auxiliary member arranged upstream of the transfer member in the predetermined direction, and a carrying member arranged between the transfer member and the auxiliary member, and configured to move in the predetermined direction and to contact the developer image carrier;

wherein the auxiliary member contacts the carrying member.

* * * * *